US008727293B2

(12) United States Patent
Tait et al.

(10) Patent No.: US 8,727,293 B2
(45) Date of Patent: May 20, 2014

(54) SUPPORT STRUCTURE FOR SUPPORTING VIDEO DISPLAYS

(75) Inventors: Michael Tait, Lititz, PA (US); Adam Davis, Lancaster, PA (US); James Fairorth, Lancaster, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 210 days.

(21) Appl. No.: 12/411,478

(22) Filed: Mar. 26, 2009

(65) Prior Publication Data

US 2010/0243843 A1 Sep. 30, 2010

(51) Int. Cl.
*A47F 5/00* (2006.01)

(52) U.S. Cl.
USPC ..... 248/309.1; 248/918

(58) Field of Classification Search
USPC ..... 312/265.6, 265.5; 211/74; 248/239, 248/340.3, 241, 164, 309.1; 359/455
See application file for complete search history.

(56) References Cited

U.S. PATENT DOCUMENTS

| | | | | |
|---|---|---|---|---|
| 4,660,901 | A * | 4/1987 | Shimada | 312/111 |
| 5,388,943 | A * | 2/1995 | Nadherny | 411/513 |
| 5,623,786 | A | 4/1997 | DeMeyer | |
| 5,738,422 | A * | 4/1998 | Welborn et al. | 312/198 |
| 5,802,772 | A | 9/1998 | Burke et al. | |
| 6,021,909 | A * | 2/2000 | Tang et al. | 211/183 |
| 7,088,508 | B2 * | 8/2006 | Ebina et al. | 359/455 |
| 7,126,816 | B2 * | 10/2006 | Krah | 361/679.55 |
| 7,604,491 | B1 * | 10/2009 | Ahmad et al. | 439/82 |
| 2001/0026247 | A1 * | 10/2001 | Nishio et al. | 345/4 |

* cited by examiner

*Primary Examiner* — Amy J Sterling
(74) *Attorney, Agent, or Firm* — McNees Wallace & Nurick LLC

(57) ABSTRACT

A video support structure for supporting video, a video display system, and a method of securing the support structure are disclosed. The video support structure includes a first support member, a second support member, a portion of the second support member being receivable by a surface or space formed by the first support member, a pinnable joint having an opening in each of the first support member and the second support member, the openings being alignable to receive one or more pins, and the one or more pins, the one or more pins being configured to secure the first support member to the second support member to form at least a portion of the video support structure.

16 Claims, 6 Drawing Sheets

SUPPORT STRUCTURE FOR SUPPORTING VIDEO DISPLAYS

FIELD OF THE DISCLOSURE

The present disclosure relates to display systems and structures for supporting the same. More specifically, the present disclosure relates to modular structures for supporting lighting display components and video display systems formed of individual components secured by pinned connections and a method for making the same.

BACKGROUND OF THE DISCLOSURE

In the performance industry, welded structures are typically used to support multi-media systems utilized in productions, such as theatrical events or concerts. Welded components are heavy and require very skilled fabricators to maintain joint quality and tolerances. In addition, portions of welded structures cannot be easily removed for repair or replacement. The assembly of video support structures may require complex manufacturing methods, requiring complicated or expensive tools (including, but not limited, to welding tools).

When being used as part of a touring production, structures for supporting components can be subjected to physical strain. Structures for supporting components may frequently be assembled and handled by individuals of varying level of skill and assembled and disassembled into larger video displays. In addition, temperature changes and/or other environmental stressors (for example, changes in humidity) may occur due to changes in facilities, changes in transportation systems, traveling from one environment to another, and/or other ways. Such exposure causes cyclical expansion and contraction of video support structures, making components susceptible to damage, particularly at joints. In order to provide joints that withstand these stressors, manufacturers have relied upon welded joints, which result in heavy equipment and require skilled fabricators.

Therefore, there is an unmet need to provide lighter weight structures supporting lighting display components, such as video components, that are easily fabricated, have components that are reparable or replaceable, and have joints that are resistant to stressors encountered by portable multi-media display support components.

SUMMARY OF THE DISCLOSURE

One aspect of the disclosure refers to a video support structure for supporting video including a first support member, a second support member, a portion of the second support member being receivable by a surface or space formed by the first support member, a pinnable joint having an opening in each of the first support member and the second support member, the openings being alignable to receive one or more pins, and the one or more pins, the one or more pins being configured to secure the first support member to the second support member to form at least a portion of the video support structure.

Another aspect of the disclosure refers to a video display system including a video support structure for supporting video and a light emitting unit secured to the video support structure. In the embodiment, the video support structure includes a first support member, a second support member, a portion of the second support member being receivable by a surface or space formed by the first support member, a pinnable joint having an opening in each of the first support member and the second support member, the openings being alignable to receive one or more pins, and the one or more pins, the one or more pins being configured to secure the first support member to the second support member to form at least a portion of the video support structure.

Another aspect of the disclosure refers to a method of securing a method of securing a video support structure for supporting video including providing first support member and a second support member, securing the first support member to the second support member by the one or more pins, and a portion of the at least one first support member being receivable by a surface or space formed by the second support member. In the embodiment, the first support member and the second support member have a pinnable joint securable by one or more pins, the pinnable joint has an opening in each of the first support member and the second support member, the opening being alignable to receive the one or more pins.

An advantage of the present disclosure is that the assembly and structure for supporting video components can be easily assembled with little or no specialized tools or skill.

Another advantage of the present disclosure is that the assembly and video support structure provide resistance to environmental and other stressors. In particular, the assembly and video support structure can be resistant to the stressors and abuse encountered by portable components that are frequently shipped, stored, assembled, and disassembled in a variety of environmental conditions.

Yet another advantage of the present disclosure is that the video support structures can be easily fabricated with little or no welding.

Still yet another advantage of the present disclosure is that the system and video support structures provide increased flexibility with respect to maintenance, repair and replacement.

Further aspects of the method and system are disclosed herein. The features as discussed above, as well as other features and advantages of the present disclosure will be appreciated and understood by those skilled in the art from the following detailed description and drawings.

DESCRIPTION OF THE DISCLOSURE

Figure 1:
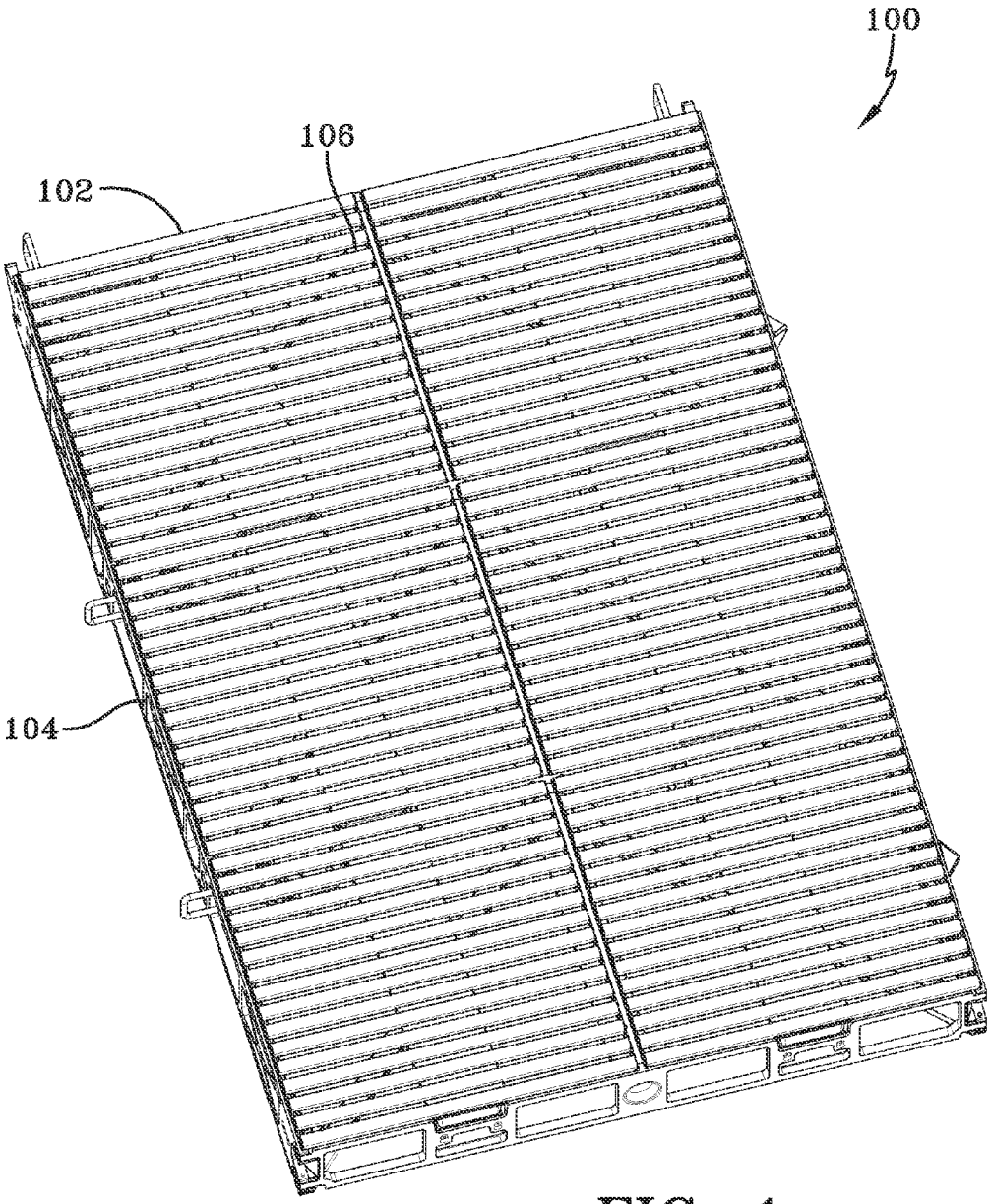
FIG. 1 shows a perspective view of an exemplary embodiment of a video display system.

FIG. 1 shows a video display system 100. Video display system 100 can include light emitting units 102 and a video support structure 104. In an exemplary embodiment, the light emitting units may be a plurality of sets of light emitting diodes (LEDs). In another embodiment, the light emitting units may include other light sources, for example organic light emitting diodes (OLEDs), incandescent bulbs, fluorescent bulbs, polymer light emitting diodes, electroluminescent lights, other suitable light emitting sources, and/or a combination of light emitting units. The light emitting units 102 may be provided as individual elongate units or may be units of alternate geometries that provide the desired visual or video effect. Light emitting units 102 can be individually secured to video support structure 104 by a plurality of clips 106 or other suitable securing device. As will be appreciated, clips 106 may be separate or integral with video support structure 104. In one embodiment, the light emitting units 102 (or other light sources) may be secured by adhesive. In another embodiment, the light emitting units 102 (or other light sources) may be secured by a plurality of fasteners.

Figure 2:
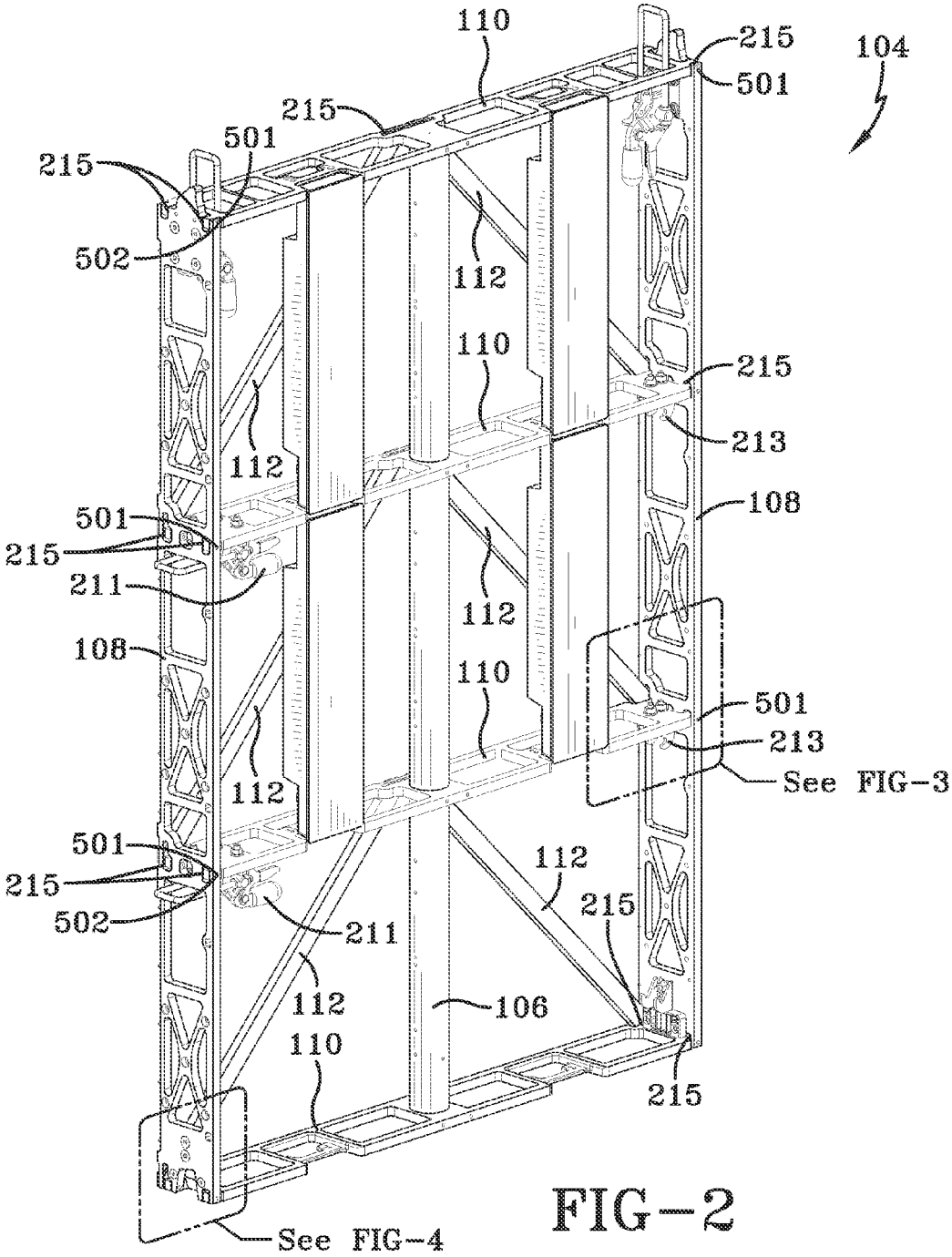
FIG. 2 shows perspective view of an exemplary embodiment of a video support structure.
Figure 4:
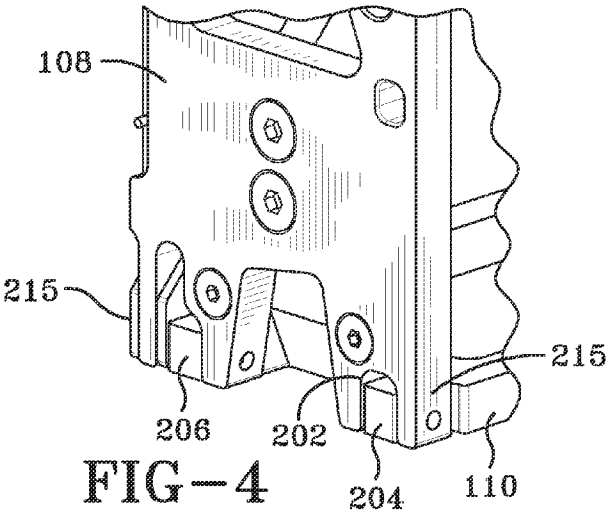
FIG. 4 shows another enlarged perspective view of the video support structure in FIG. 2.
Figure 3:
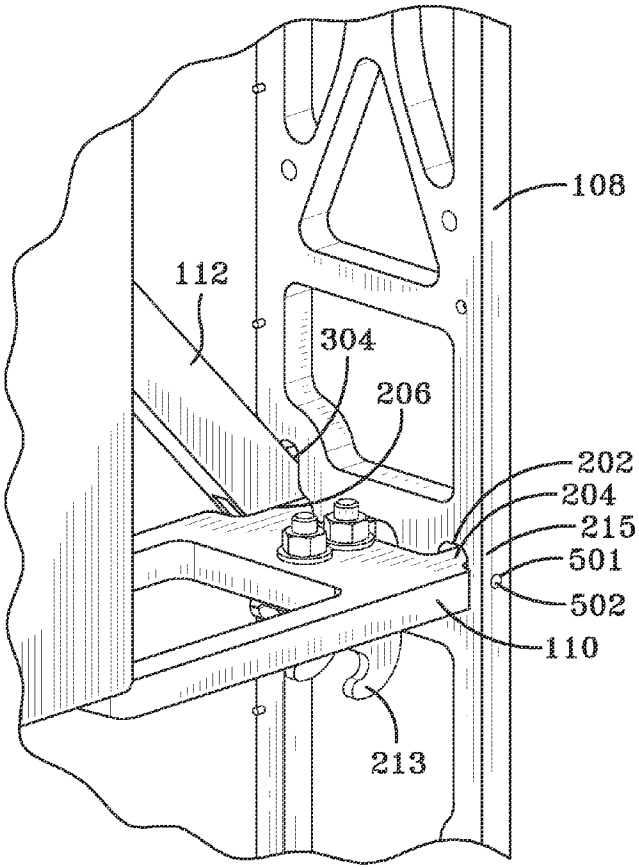
FIG. 3 shows an enlarged perspective view of the video support structure in FIG. 2.

FIGS. 2 through 4 show video support structure 104 including a support member 108, a cross member 110, and a brace 112. Two support members 108 can be included, four cross members 110 can be included, and six braces 112 can be included. Each of the connections provided between support members 108, cross members 110, and braces 112 can include at least one pinned connection (see FIGS. 3 and 4).

Support members 108 bound two outer portions of video support structure 104. In other embodiments, more or fewer than two supports members 108 may be included. Each support member 108 can be arranged and disposed to attach to four cross members 110 and three braces 112. Each of the connections between support member 108 and either cross member 110 or brace 112 include a pinnable joint 215. The term "pinnable joint" as used herein, is meant to include a joint or pinned connection securable by a pin or similar device passed through an opening 501 in each of the joining components. In other embodiments, support member 108 may be arranged and disposed to attach to fewer or more cross members 110 and/or braces 112.

Figure 6:
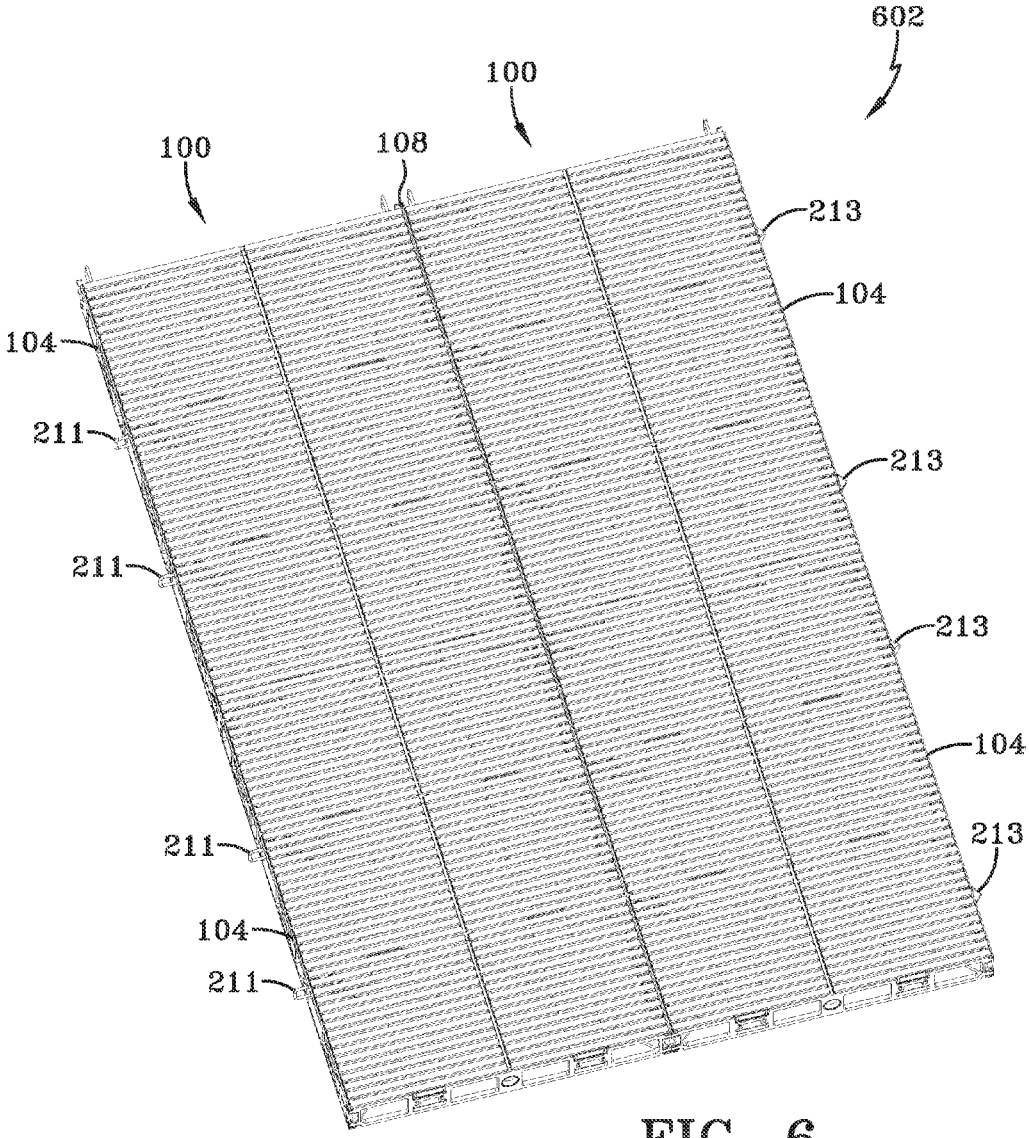
FIG. 6 shows a perspective view of another exemplary embodiment of a video display.

In yet another embodiment, as further shown in FIG. 6, a plurality of video display systems may be connected to each other at or near a support of video support structure 104. Referring to FIGS. 2 and 6, video support structures 104 can include latches 211 and hooks 213. Latches 211 and hooks 213 can be fastened along cross members 110 such that the latches can engage and secure adjacent video support structures 104. Additionally or alternatively, latches 211 and hooks 213 can be included on support member 108 to engage video display systems 100 above or below. As shown in FIG. 6, the plurality of video display systems 100 can produce a video display 602. In one embodiment, video display system 100 may be modular. Video display 602 can be supported by the connections between the video display systems 100 or can be supported by a cable or other device that is capable of disributing the weight of the video display 602 and provides stadility and/or support. Video display 602 can be used in theatrical events, concerts, and/or other suitable presentations. In one embodiment, the combined weight of video display systems 100 constituting video display 602 is less than the combined weight of systems including welds that form a video display. In another embodiment, video display systems 100 and, thus, video display 602 can be fabricated from materials that are not desirable or unsuitable for welding.

Referring again to FIGS. 2 through 4, support member 108 can be configured to interlock with another support member 108 or a corresponding support (not shown). Support member 108 can be fabricated from any suitable material. Suitable materials may include metal, such aluminum or other machined or formable metal. The material should be strong enough to provide adequate support to light emitting units 102 (and/or another light source), but not be undesirably heavy. In addition, the material for fabrication should be able to flexibly handle strain, temperature variations and environmental conditions. In other embodiments, the support may be of a different material including, but not limited to, steel, composite or ceramic, such as stainless steel or carbon composite.

In one embodiment, cross member 110 can be arranged and disposed to receive two support members 108 and four braces 112. In other embodiments, the member may be arranged and disposed to receive more or fewer of the supports and/or the braces. Brace 112 can be arranged and disposed to receive one support member 108 and two cross members 110. Generally, brace 112 should decrease shifting between support member 108 and cross member 110. The use of brace 112 provides resistance to shifting or flexing of the structure that may cause video support structure 104 to lose its rectangular shape, for example altering the desired geometry from the rectangular shape to a rhombus shape. Shifting in such a manner could result in forces detaching light emitting units 102 (and/or other light sources) from support member 108 and cross member 110. Cross member 110 and brace 112 may be fabricated from any suitable metal including, but not limited to, the same materials from which support member 108 is fabricated. Suitable materials include, but are not limited to, aluminum, steel, composite or other machinable material.

Figure 5:
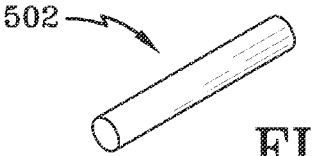
FIG. 5 shows a perspective view of an exemplary pin.

The arrangement of support members 108, cross members 110, and braces 112 can include pinnable joints 215 that engage and attach the individual support members 108, cross members 110, and/or braces 112 into a locked position. The pinnable joints 215 can include pins 502 or other suitable pin-like devices that can be compression fit or otherwise driven and retained in openings 501 in the support members 108, cross members 110, braces 112 and/or other components of the video display system 100. In one exemplary embodiment, the pinnable joints 215 may lock and engage the joints between the support members 108, cross members 110, and/or braces 112. In another exemplary embodiment, the pinnable joints 215 may form tight tolerances for the assembled video display system 100. In the embodiment shown in FIG. 2, a plurality of pins 502 (see FIG. 5) can be included for use in the pinnable joints 215. Pins 502 can be a cylindrical body or other suitable geometry. Pins 502 can be inserted into openings 501 that have been formed in support member 108 at a portion at or near where support member 108 receives cross member 110. Pins 502 can pass through support member 108 into a corresponding opening 501 in cross member 110. In an exemplary embodiment, the pin 502 may be compression fit or otherwise driven into openings 501, such that pin 502 is held in place. In another exemplary embodiment, this portion may be where brace 112 is received by support member 108. In this embodiment, pin 502 may be inserted through openings 501 in each of support member 108, member 110, and brace 112.

Figure 9:
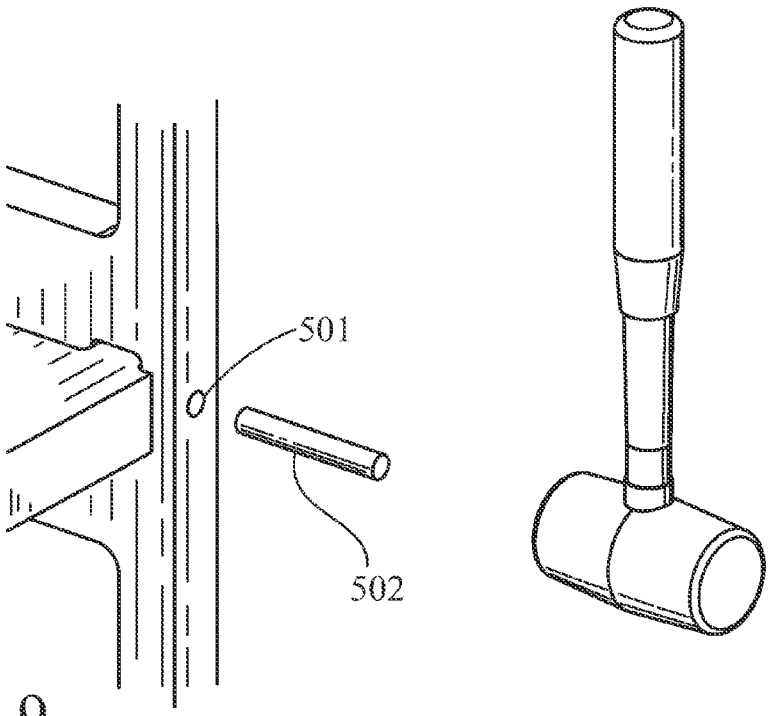
FIG. 9 shows one or more pins capable of being secured by a rubber mallet according to the disclosure.
Figure 10:
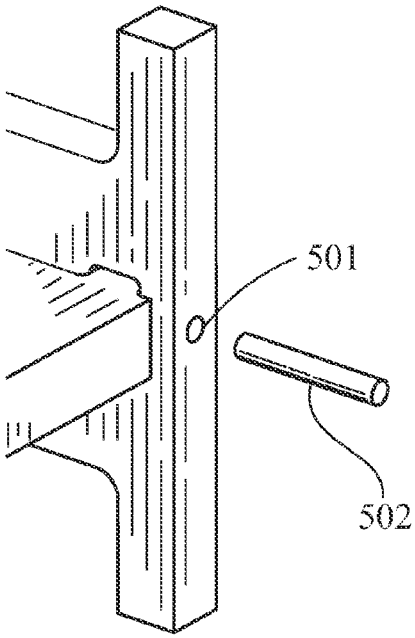
FIG. 10 show one or more pins having a diameter slightly larger than an opening according to the disclosure.

Pin 502 can be inserted through support member 108 and cross member 110 proximal to where the light emitting units 102 are affixed to support member 108 and cross member 110. In one embodiment, insertion of pin 502 may be proximal to light emitting units 102 (and/or other light sources) to prevent pin 502 from protruding from support member 108. Such protrusion may result in an uneven surface to receive the light emitting units (and/or other light sources). Pin 502 can be of a diameter slightly larger than the diameter in the corresponding openings 501 (see FIG. 10). This slightly larger diameter can permit pins 502 to compress upon being inserted through support member 108 and cross member 110 or support member 108, cross member 110, and brace 112. Upon being compressed, pin 502 can be secured. In one embodiment, insertion of the pins may be achieved by striking the pins with a rubber mallet (see FIG. 9) or other similar tool. In other embodiments, pins 502 may be of a diameter smaller than openings 501.

Figure 7:
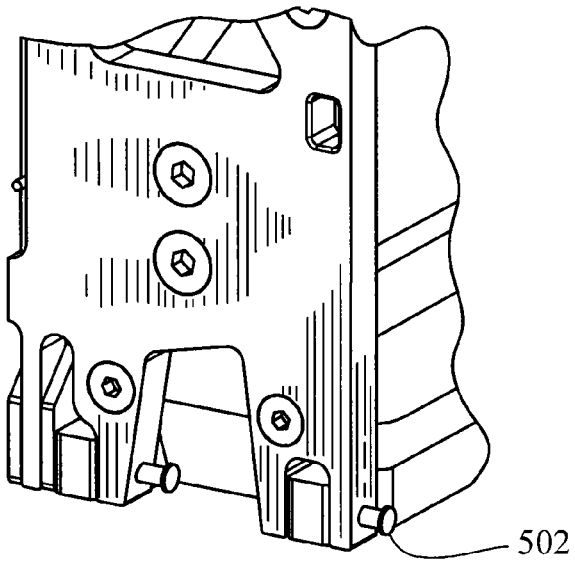
FIG. 7 shows one or more pins capable of being secured by flaring the end of the one or more pins according to the disclosure.
Figure 8:
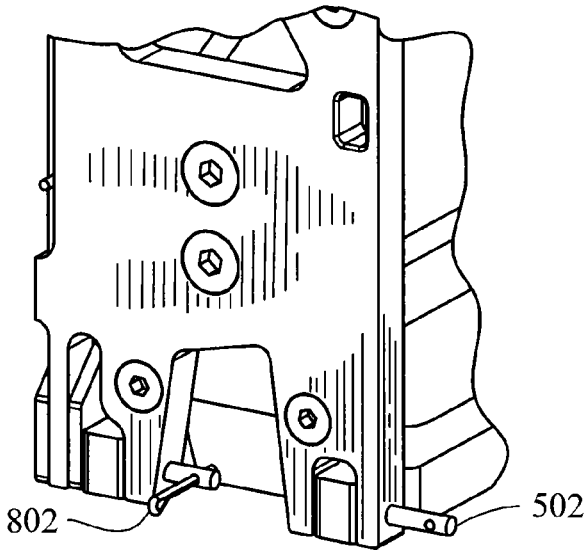
FIG. 8 shows one or more pins capable of being secured by inserting a cotter pin into the one or more pins according to the disclosure.

Upon pin 502 being inserted through support member 108 and cross member 110 or support member 108, cross member 110, and brace 112, pin 502 can be secured by flaring the end of pin 502 (see FIG. 7). In one embodiment, pin 502 may be secured by using a cotter pin or similar device (see FIG. 8). In another embodiment, pin 502 may include angled portions allowing it to be rotated and secured. In another embodiment, pin 502 may be secured by adhesive. In another embodiment, the retention of pins 502 in the pinned connection may be such that repair or replacement may require pins 502 to be removed or otherwise displaced. Upon removal of pins 502, components such as support members 108, cross members 110, and braces 112, can be repaired or replaced and a new pinnable joints 215 can be formed.

Referring to FIGS. 3 and 4, corresponding geometry of support member 108, cross member 110, and brace 112 can permit pins 502 to secure video support structure 104. Support member 108 can include an opening 202 configured to receive a protrusion 204 of cross member 110. Opening 202 and protrusion 204 can be secured by pin 502 at pinnable joints 215. Generally, opening 202 and protrusion 204 while secured can form a right angle through formation of two pinnable joints 215; however, some relative movement may occur to permit metal to relax, to permit flexibility, and to permit metal to expand such as during changes in temperature.

The geometry of support member 108, cross member 110, and brace 112 on internal portions of video support structure 104 can be similarly configured to provide corresponding substantially coplanar surfaces. Referring to FIGS. 3 and 4, the pinnable joints 215 permit pins 502 to secure video support structure 104. The corresponding geometry of support member 108 and cross member 110 at the internal portions of video support structure 104 can provide a non-planar surface. In other embodiments, the corresponding geometry of support member 108 and cross member 110 at the internal portions of video support structure 104 may provide a substantially planar surface for affixing light emitting units 102 (and/or other light sources). The geometry of support member 108 and cross member 110 can further correspond with the geometry of brace 112. The geometry of support member 108 can include enlarged opening 304 corresponding with brace 112. The geometry of cross member 110 can include recessed portion 206 permitting brace 112 to be secured by pin 502 at pinnable joints 215 with support member 108 and cross member 110, while being substantially coplanar with portions of support member 108 and portions of cross member 110.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A video display system comprising:

a first video support structure for supporting video comprising:

a first support member;

a second support member, a portion of the second support member being receivable by a surface formed by the first support member; a pinnable joint having an opening in each of the first support member and the second support member, the openings being alignable to receive one or more pins; and the one or more pins being configured to compression fit into the aligned openings of the first support member and the second support member to secure the first support member to the second support member to form at least a portion of the video support structure;

a first light emitting unit secured to the first video support structure; and a second video support structure abutting and detachably engaged to the first video support structure;

a second light emitting unit secured to the second video support structure;

the first light emitting unit and the second light emitting unit operating cooperatively to display a larger visual or video effect than what is displayable on the first light emitting unit.

2. The system of claim 1, wherein the light emitting units is selected from the group consisting of light emitting diodes, organic light emitting diodes, polymer light emitting diodes, electroluminescent lights, and combinations thereof.

3. The system of claim 1, wherein the pinnable joint is substantially devoid of welds.

4. The system of claim 1, further comprising one or more braces, each of the one or more braces secured to the first support member and the second support member with the pinnable joint.

5. The system of claim 4, wherein the one or more pins are configured for being compression fit into the opening in, one or more braces.

6. The system of claim 1, wherein the one or more pins are capable of being secured by flaring the end of the one or more pins.

7. The system of claim 1, wherein the portion of the second support member is a protrusion.

8. The system of claim 1, wherein the first support and the second support form a right angle at the pinnable joint.

9. The system of claim 1, wherein the one or more pins are held in place upon being secured.

10. The system of claim 1, wherein the one or more pins are capable of being secured by being driven into the opening.

11. The system of claim 1, wherein the one or more pins are capable of being secured by a rubber mallet.

12. The system of claim 1, wherein the one or more pins have a diameter slightly larger than the opening.

13. The system of claim 1, wherein the one or more pins have a cylindrical body.

14. The system of claim 1, wherein the first support member and the second support member are metal.

15. The system of claim 1, wherein repair or replacement of the one or more pins requires removal.

16. The system of claim 4, wherein the surface formed by the first support member is coplanar with the one or more braces.

* * * * *